United States Patent [19]

Steele et al.

[11] 3,939,231

[45] Feb. 17, 1976

[54] CARBURETTORS AND ASSOCIATED COMPONENTS

[75] Inventors: William Henry Steele, Bonnet Bay; George Nejtek, Condell Park, both of Australia

[73] Assignee: Victa Limited, Milperra, Australia

[22] Filed: Sept. 19, 1973

[21] Appl. No.: 398,800

[30] Foreign Application Priority Data

Sept. 20, 1972 Australia ..... 507/72

[52] U.S. Cl. ..... 261/62; 261/64 B; 261/64 E; 123/103 B

[51] Int. Cl.[2] ..... F02M 1/02; F02M 9/12

[58] Field of Search ..... 261/62, 64 E, 64 B, 64 R, 261/64 C; 123/103 B

[56] References Cited

UNITED STATES PATENTS

| | | | |
|---|---|---|---|
| 2,529,242 | 11/1950 | Brown et al. | 261/62 |
| 2,646,264 | 2/1953 | Morris | 261/44 R |
| 3,224,746 | 12/1965 | Boyle et al. | 261/50 A |
| 3,333,832 | 8/1967 | O'Neill | 261/44 R |
| 3,439,903 | 4/1969 | Tolnai | 261/50 A |
| 3,485,483 | 12/1969 | Pohlman | 261/50 A |
| 3,650,252 | 3/1972 | Glover et al. | 123/103 B |
| 3,767,173 | 10/1973 | Ishii | 261/69 A |

FOREIGN PATENTS OR APPLICATIONS

| | | | |
|---|---|---|---|
| 528,939 | 11/1940 | United Kingdom | 261/50 A |
| 134,420 | 9/1949 | Australia | 123/103 B |

*Primary Examiner*—Tim R. Miles
*Attorney, Agent, or Firm*—Haseltine, Lake & Waters

[57] ABSTRACT

A carburettor incorporating within its housing and at one end of its mixing chamber a governing diaphragm having balancing springs and being connected with the stem of a poppet-type valve serving as the throttle control, a connection for air of sub- or super-atmospheric pressure varying as an indication of engine speed, and a rotatable manually controlled element within the housing and operating on a carriage to vary the pressure in one of the diaphragm springs to alter the balance of the diaphragm and effect change in throttle setting.

13 Claims, 10 Drawing Figures

CARBURETTORS AND ASSOCIATED COMPONENTS

This invention relates to carburettors and associated components and more particularly to a simplified throttle valve mechanism and vacuum operated diaphragm governor control for a carburettor.

Present known carburettors of the general type to which this invention relates usually incorporate a plurality of exposed moving parts which suffice to operate the throttle valve. These exposed moving parts are particularly prone to damage from external sources and to corrosion and the like. Furthermore these types of carburettors, due to their construction, have several exposed orifices through which foreign matter may pass to cause damage to the internal components thereof.

In some types of installations there is a requirement for governed control of the engine speed in a selective range of engine R.P.M. with respect to the engine loading. Generally this is achieved by way of an independent governor control mechanism mounted on the engine and connected by way of linkage to the throttle control mechanism. This type of apparatus is defective in that it is expensive and very complicated. In the past there has been some attempt at producing a carburettor with an integral governor control. One such type of carburettor comprises a pressure sensitive capsule connected between the throttle control mechanism and the throttle valve. The capsule is located in a chamber communicating with the inlet manifold. The function of the capsule is to override the manual throttle setting and control the engine speed with respect to the manifold depression. This type of mechanism is particularly defective in that it is also sensitive to temperature changes in the manifold and cannot therefore function properly without a high degree of manual control to compensate for manifold temperature changes.

It is an object of the present invention to provide a carburettor that is substantially free from these defects.

It is another object of this invention to provide a diaphragm operated governor control that may be used with substantially any suitable type of carburettor to provide effective control of engine speed within a predetermined range of throttle opening with respect to the engine loading.

In one general form the invention is a carburettor for deriving a fuel/air mixture for application to a gas engine, comprising a housing, a fuel/air mixing chamber in the housing connected to an outlet, a valve seat in the housing in the path of fuel/air mixture passing to the outlet, a poppet-type valve displaceable to and from the valve seat to control the flow of fuel/air mixture to the outlet, a movable diaphragm supported in the housing and forming at least part of a wall of a compartment and being connected with the poppet valve, means for biasing the movement of the diaphragm, a manual throttle control element within the housing operable to change the bias on the diaphragm, and means in fluid connection with the compartment for deriving fluid pressure changes indicative of changes in speed of the engine, whereby response of the diaphragm to fluid pressure changes causes displacement of the poppet valve with respect to the valve seat.

The invention will now be described by reference to a preferred embodiment illustrated by the accompanying drawings, in which.

Figure 1B:
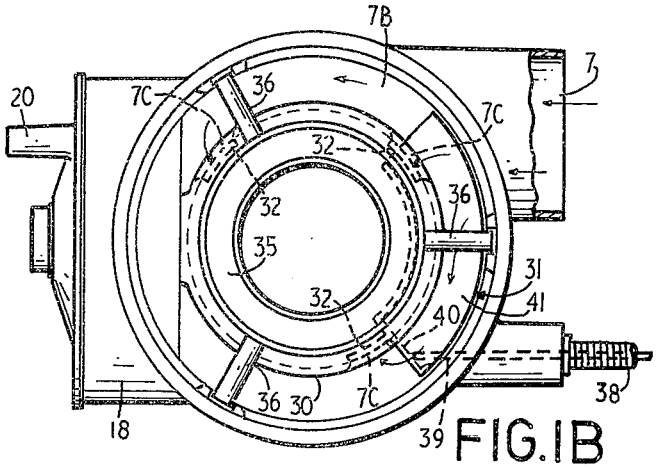
FIG. 1 shows a carburettor incorporating the invention with its throttle in the engine start position, and comprises a set of three illustrations, viz. (A) a vertical sectional view through the carburettor, (B) a plan view with the diaphragm control removed, and (C) a diagrammatic representation of the functioning of the manual throttle arrangement in the carburettor.

A basic form of carburettor incorporating the invention is shown by the drawings and consists of a float chamber 4, a mixing chamber 5, a venturi 6 in the mixing chamber 5, an air inlet 7 and a mixture outlet 8. As with conventional carburettors fuel flow to the mixing chamber 5 is achieved by way of at least one fuel jet 9 connecting the float chamber 4 with the venturi 6. In the present invention the flow of the fuel/air mixture from the mixing chamber 5 to the outlet 8 is controlled with a poppet valve 10. This valve 10 comprises a conical valve head 11 having a valve face 12 at its base to engage, when in the closed position, a complimentary valve seat 13 on the venturi 6 in the mixing chamber 5.

The valve 10 is mounted relative to the valve seat 13 by way of a stem portion 14 extending coaxially from its base and received slideably in a valve guide 15 at one end of the mixing chamber 5. Control of the fuel/air mixture flow to the outlet 8 is achieved by axially moving the valve 10 a selected distance between a fully open position and a fully closed position with resulting control of engine power. The valve guide 15 is supported at the end of the mixing chamber 5 by a plurality of circumferentially spaced radial webs 16.

Figure 3B:
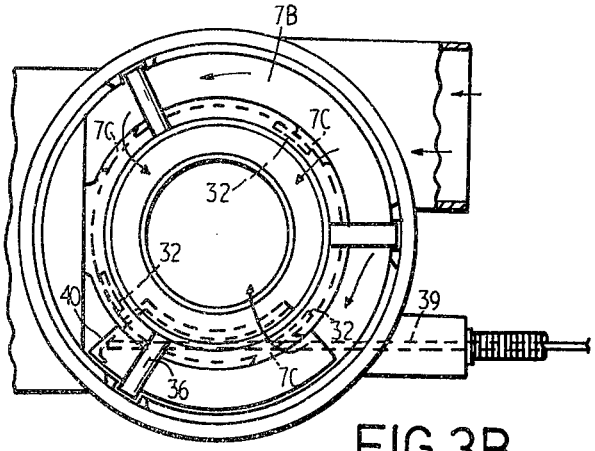
FIG. 3 shows the carburettor in idling condition.
Figure 3C:
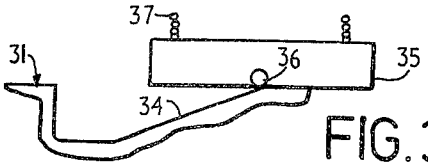
Figure 3A:
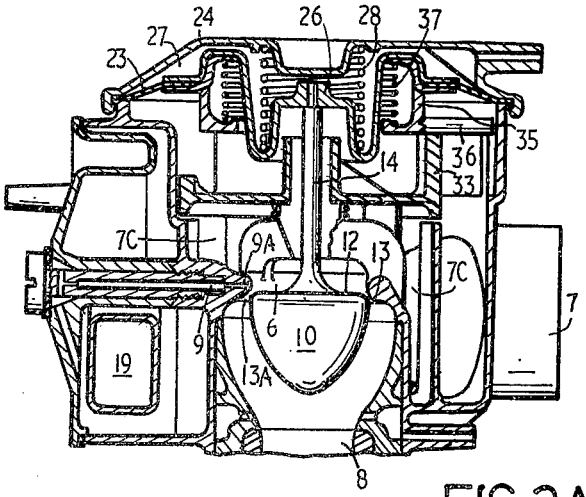

The volume of fuel/air mixture required for engine idling may be obtained as shown in FIG. 3 (*a*) by relieving the valve seat 13 at point 13A adjacent the emulsion hole 9A or alternatively by way of a bleed hole (not shown) extending through the valve head 11. The latter method is the most desirable in that by turning the valve 10 the bleed hole may be moved circumferentially away from the emulsion hole 9A to provide a lean mixture or toward it to provide a rich mixture. In another form however the valve 10 when in the closed position may be set with a minimal clearance between the face 12 and the seat 13 to permit the correct flow of fuel/air mixture for the engine idling speed.

Air flow to the mixing chamber 5 is by way of a radial passage 7A to an annular chamber 7B surrounding the mixing chamber 5 and communicating with it through orifices 7C in a raised flange 30 forming an inner wall for the annular chamber 7B.

The fuel jet 9 is preferably on the axis of the cylindrical float chamber 4 which has one end wall 17 and side wall 18 integrally formed with the housing of the carburettor. The float valve 4 and float mechanism 19 as well as the fuel supply pipe 20 are mounted on a rotatable cap 21 serving as the other end wall. Extending coaxially from the inner face of this cap, which is also removable, is a hollow screw 22 which is in communication with the emulsion hole 16 in the venturi 6. The cap 21 is retained in sealing contact with the float chamber 4 by the screw 22, which serves as the fuel jet 9. Fuel supply to the emulsion hole 9A is obtained via a passage or small conduit 21A on the cap 21 extending from below the normal fuel level.

Governor control for the carburettor is provided. This includes the provision of a fluid pressure-operated diaphragm control comprising an annular resilient flexible diaphragm 23 with its outer peripheral edge retained between a cap 24 and a flange 25 on the upper end of the housing. Its inner peripheral edge is secured to a coaxial annular cup shaped member 26 which is mounted on the poppet valve stem 14. The diaphragm 23 and member 26 form one wall of a sealed compartment 27.

Mounted within the compartment 27 is a helical spring 28 which acts between the cap 24 and the cup member 26 to urge the poppet valve 10 towards its fully open position. The compartment 27 is connected by a conduit 29 to a source of fluid pressure variable with variation in engine speed. Preferably, this source is a probe on an aerofoil (not shown) which is positioned adjacent the engine cooling fan or other air impeller. The probe is mounted in such a way that the greater the volume of air drawn past it by the fan the greater will be either the pressure rise or fall applied to the compartment 27. As shown by the drawings the governor relies on changes in vacuum but by reversing the action of the valve 10, or locating compartment 27 on the reverse side of diaphragm 23 the governor will respond to changes in super-atmospheric pressures. Any other suitable means for deriving the necessary vacuum may be used. This vacuum will move the diaphragm 23 against the pressure of spring 28 and move the poppet valve 10 towards its closed position upon seat 13.

The carburettor will require choking to permit cold starting. This is achieved with a disc-shaped throttle control member 31 mounted rotatably on the valve guide 15 and closing the upper end of annular air inlet chamber 7B. The throttle control member 31 is constructed with depending obturating legs 32 for orifices 7C so that when it is rotated fully in one direction the legs 32 will substantially close off the air inlet via orifices 7C to cause a rich mixture at the venturi 6.

Figure 1C:
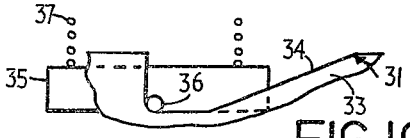
Figure 1A:
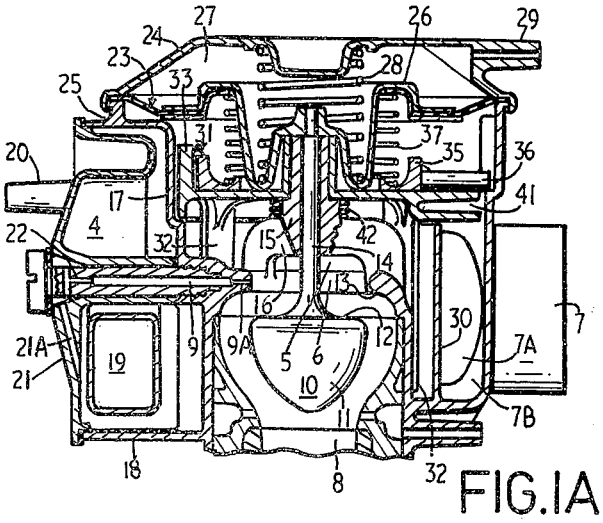

The throttle control member 31 has an upright peripheral wall 33 (see detail of FIGS. 1 (*c*), 2(*c*) and 3(*c*)) functioning as a rotatable cam and provided with three dwells in the form of inclined ramps 34. An annular cup 35 having three radially extending lifter arms 36 located within the dwells 34 of throttle member 31 supports the lower end of a bias spring 37 compressed against the underside of the cup member 26. Normally the diaphragm spring 28 overpowers the bias spring 37 and the diaphragm 23 is forced to an extreme outer limit of the compartment 27 as shown in FIG. 1 (*a*).

A manual control cable 38 with a sliding core 39 is connected with the carburettor housing to rotate the throttle control member 31. The core 39 is arranged to push an end wall 40 in a forked part 41 of the member 31 to effect manual closure of valve 10. A return spring 42 over the valve guide 15 returns the member 31 when the core 39 is withdrawn.

When the throttle control member 31 is in the start position shown by FIG. 1 the valve 10 is open to maximum and orifices 7C are almost closed permitting only sufficient air flow for starting and the lifter arms 36 as shown by FIG. 1(*c*) are therefore in a lowered position. Upon start of the engine its speed will be chosen by selective closure of valve 10 by cable manipulation.

Figure 2B:
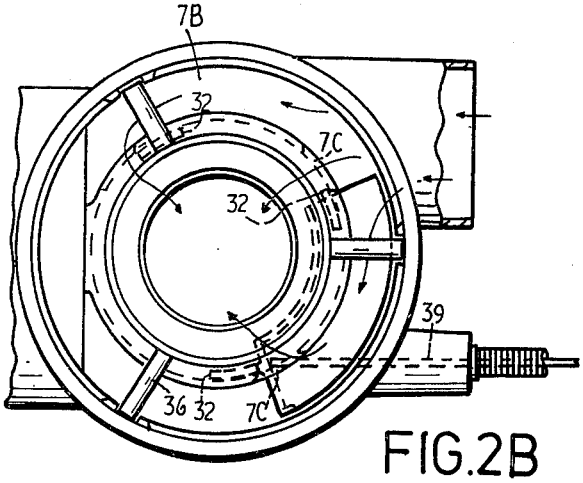
FIG. 2 is a similar showing of the carburettor of FIG. 1, but under full throttle.
Figure 2C:
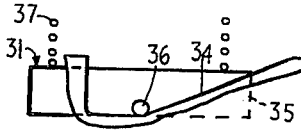
Figure 2A:
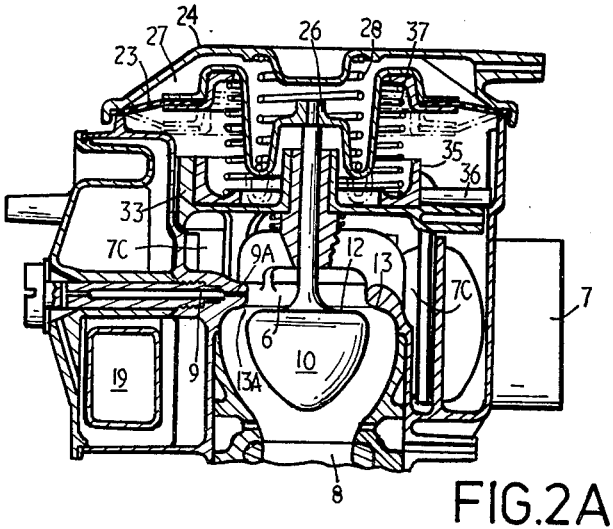

When the engine is running steadily the air pressure at the aerofoil adjacent the cooling fan will cause a vacuum to be applied to the diaphragm 23. As the poppet valve 10 is moved to its fully open position by the control cable 38 with the engine unloaded as shown by FIG. 2 the increased air flow past the aerofoil will cause a corresponding increase in the vacuum applied to the diaphragm 23 overcoming the force of the diaphragm spring 28 and drawing the diaphragm 23 into compartment 27 thus causing the poppet valve 10 to move towards closure.

Should a load be applied to the engine the engine speed will be reduced causing a corresponding reduction in the vacuum permitting the diaphragm spring 28 to move the poppet valve 10 in an opening direction to attain equilibrium between pressures applied to opposite sides of the diaphragm 23. The displaced position of diaphragm 23 under this governing control is depicted in broken outline in FIG. 2 (*a*). Thus the greater the load the less the vacuum and vice versa whereby automatic governing of the engine speed with respect to varying load conditions is obtained. A throttle setting between idling and maximum speed will place the lifter arms 36 in a position (not shown) part way up the ramps 34 so that the influence of the spring 28 is partly countered.

It will be appreciated that the effect of lifting the annular cup 35 by the rotatable cams of the throttle control member will be to increase the pressure of the bias spring 37 upon the diaphragm 23 and thereby alter its equilibrium. As a result manual selection of the engine speed is available with automatic variations of the valve 10 opening achieved to compensate for changing loads on the engine.

Figure 4:
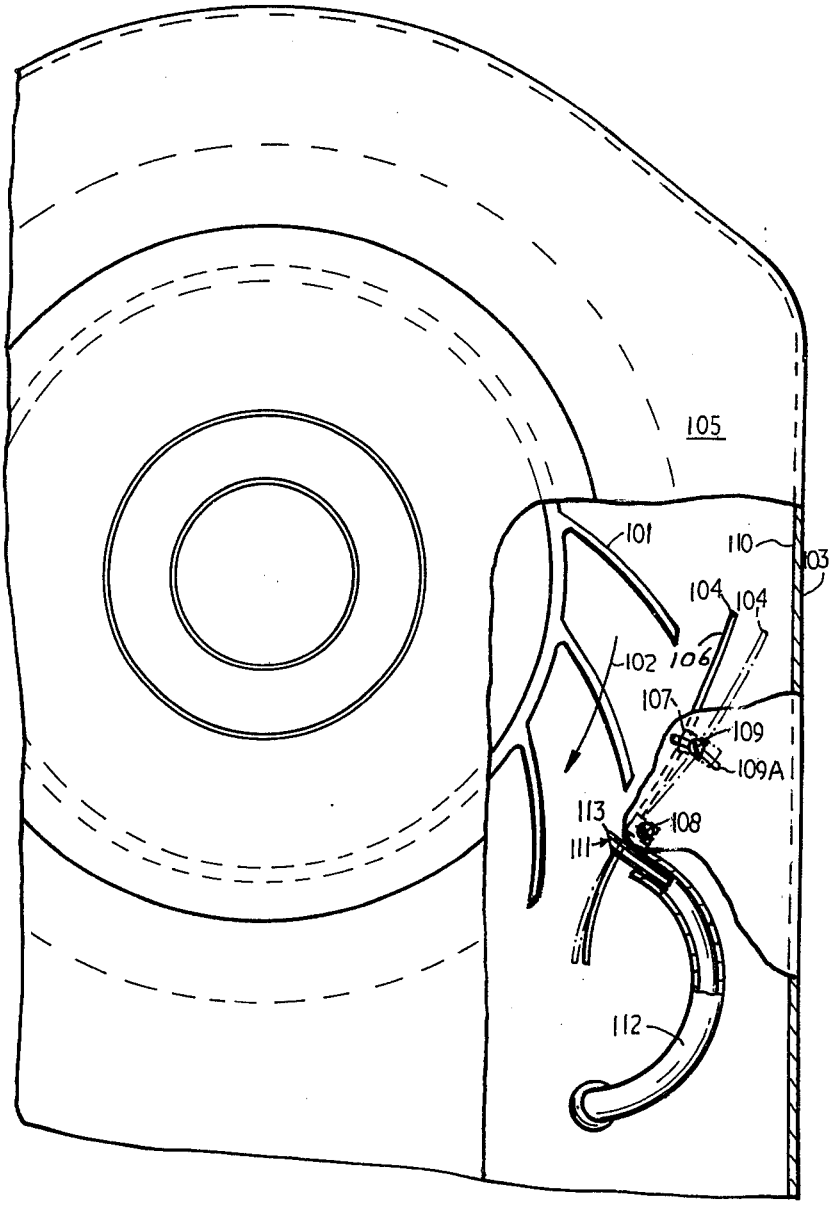
FIG. 4 is a fragmentary plan of pressure deriving means.

FIG. 4 shows a preferred embodiment of means for deriving air pressure changes indicative of changes in speed of the engine. The means are applied to an air-cooled engine having an air impeller 101 secured upon an upper end of the engine drive shaft (not shown) for direct drive from the engine. A cowling 103 encloses the impeller 101 and confines the air displaced by the impeller 101 air stream is directed by the cowling 103 over and about the engine cylinder block and other components for cooling purposes. Alternatively, the impeller 101 may be supplementary to the cooling system and the air-stream 102 either disposed of or utilised for other purposes. to a stream indicated by arrows 102 in the drawing. This An upright vane 104 is supported by the cover 105 of cowling 103 so that it projects into the air-stream 102. The vane 104 is provided with an aerofoil surface 106 and formed of sheet material with a pair of spaced tabs 107 projecting from its upper edge and bent at right-angles thereto. Each tab 107 is drilled and tapped to accept screws 108 and 109 projecting through the cowling cover 105.

By tightening of the screws 108 and 109 the relative position of the vane 104 to the impeller 101, and therefore the air-stream 102, may be secured. If the screw 108 passes through a hole in the cover 105 while screw 109 is located in an arcuate slot 109A in the cover 105, the relative position of the vane 104 to the impeller 101 may be selected. A displaced position of the vane 104 is shown in broken outline in the drawing. It will be appreciated, of course, that the vane 104 may be omitted and the aerofoil surface 106 provided on the internal upright wall 110 of the cowling 103.

A hollow probe 111 passes through and is fixed to the vane 104 at a position thereon where the pressure of the air-stream passing over the aerofoil 106 differs from atmospheric pressure. In the instance depicted in the drawing the probe is positioned at a point of sub-atmospheric pressure due to the fact that the aerofoil at that position projects into the air-stream 102. By variation of the shape of the aerofoil 106, or repositioning of the probe 111, an area of super-atmospheric pressure may be chosen for the probe 111. A flexible airline 112 is passed through the floor of the cowling 103 and connected with the outer end of the hollow probe 111. The end 113 of the probe 111 projecting into the air-stream 102 may be obliquely cut to obtain amplification of the effect of differential pressure. As depicted in the drawing the inclination of end 113 of probe 111 faces out of the air-stream to accentuate the reduction of air pressure. On the other hand, if the aerofoil 106 was shaped at the position of insertion of the probe 111 so that it recedes from the air-stream a reduction in velocity of the air-stream 102 past the probe 111, and consequential increase in pressure, will result.

In a relatively small engine, such as a two-stroke or four-stroke engine, a single firing chamber is utilised and the carburettor may be attached directly to the cylinder housing without the requirement for an inlet manifold. In modern engine design it is frequently desirable to provide automatic control of engine function, e.g. ignition advance, or engine speed governing. In both instances a diaphragm control may be used responding to increases or decreases in fluid pressure which are indicative of engine speeds. By the invention there is provided a diaphragm control device (not shown) of any suitable kind with balancing means, such as internal helical springs, for the diaphragm and linkage connecting diaphragm movement to a valve or other member to control the engine function.

In one form of the invention the fluid line 112 is connected at its outer end to a sealed chamber on one side of the diaphragm. The diaphragm will then respond to fluid pressure changes which will be a representation of changes in engine speed. The position adjustment of vane 104, due to the accommodation of fixing screw 109 within a slot in the cowling 103, will enable ready adjustment to be made for optimum functioning of the diaphragm control.

What we claim is:

1. A carburettor for deriving a fuel/air mixture for application to a gas engine subject to changing loads, comprising a housing, individual inlet means to said housing for fuel and air, a fuel/air mixing chamber in said housing connected to an outlet, a valve seat in said housing and in the path of fuel and air passing from said inlet means to said chamber, an axially displaceable valve co-operating with said valve seat to control the flow of fuel and air to said chamber, a second chamber in said housing, an element movable within said second chamber and dividing said second chamber into two compartments and connected to said valve to open and close said valve, a manually operable throttle control for said engine including a rotatable throttle control member within said housing and coaxial with said valve and connected with said movable element to change the position thereof within said second chamber to determine the open condition of said valve with respect to said valve seat, said open condition corresponding to a selected speed of said engine, resilient means for biasing said movable element to said changed position, and an automatic speed governor control for said engine including means for fluid connection with a first one of said compartments for communicating thereto fluid pressure changes indicative of changes in speed of said engine, said fluid pressure changes effecting movement of said movable element with respect to its said changed position to increase said open condition of said valve with decreasing speed of said engine and to decrease said open condition of said valve with increasing speed of said engine, thereby maintaining substantially uniform speed of said engine corresponding to said selected speed.

2. A carburettor according to claim 1, wherein said resilient biasing means for said movable element includes springs in respective ones of said compartments, each spring compressibly acting upon said movable element, said throttle control member being located within a second one of said compartments and one of said springs being compressed between said throttle control member and said movable element.

3. A carburettor according to claim 2, wherein said changed position of said movable element is achieved by altering the degree of compression of said spring in said second compartment.

4. A carburettor according to claim 3, wherein the relative tensions of said springs are such that in the fully opened condition of said valve the spring in said first compartment overpowers the spring in said second compartment and forces said movable element against an abutment within said second compartment, and said movable element in moving to said changed position vacates said abutment under increased tension in said second spring.

5. A carburettor comprising a housing, individual fuel and air inlet means to said housing, a fuel/air mixing chamber in said housing connected to an outlet, a valve seat in said housing between said chamber and said individual fuel and air inlet means, an axially displaceable valve within said housing and co-operating with said valve seat to open and close thereby to control the flow of fuel and air into said mixing chamber, throttle means including a throttle control element within said housing and rotatable about the axis of said valve, means for manually controlling the rotation of said throttle control element, a displaceable mount for said valve, a cam face on said throttle control element co-operating with said displaceable mount to increase the opening of said valve upon rotation of said throttle control element corresponding to advancement of said throttle means and to decrease the opening of said valve upon rotation of said throttle control element corresponding to retarding of said throttle means.

6. A carburettor according to claim 5, wherein said throttle control element includes a carriage slidably displaceable along the axis of said valve and abutting said cam face for control of its sliding movement.

7. A carburettor according to claim 6, including a plurality of said cam faces each adjacent a respective cam dwell on said throttle control element and each of ramp shape, said carriage having a plurality of radially extending arms engageable in respective cam dwells when said valve is fully opened and contacting said ramp shaped cam faces when said valve is at least partly closed.

8. A carburettor according to claim 5, wherein the air from said air inlet means passes to said valve seat via an orifice, said rotatable throttle control element carrying a projection which at least partly closes said orifice in one rotated position of said throttle control element.

9. A carburettor according to claim 8, including a plurality of said orifices, said throttle control element and said carriage being concentric, said throttle control element carrying a plurality of projections comprising legs depending from said throttle control element.

10. A carburettor for deriving a fuel/air mixture for application to a gas engine subject to changing loads, comprising a housing, individual inlet means to said housing for fuel and air, a fuel/air mixing chamber in said housing connected to an outlet, a second chamber in said housing, a valve seat in said housing between said chambers and in the path of fuel and air passing from said inlet means to said mixing chamber, and axially displaceable poppet-type valve having a head and a stem and co-operating with said valve seat to open and close and thereby control the flow of fuel and air to said mixing chamber, a movable element dividing said second chamber into two compartments and connected with the stem of said valve to open and close said valve, a manually operable throttle control for said engine including a throttle control member between said movable element and said valve seat and rotatable about the axis of said valve stem, a cam face on said throttle control member, a carriage in contact with said throttle control member slidable under control of said cam face within a first one of said compartments, first spring means within a second one of said compartments and urging said movable element towards said first compartment, second spring means compressed between said carriage and said movable element to change the position within said second chamber of said movable element with sliding of said carriage thereby to change the open condition of said valve with respect to said valve seat, said changed open condition corresponding to a selected speed of said engine, and an automatic speed governor control for said engine including means for fluid connection with said second compartment for communicating thereto fluid pressure changes indicative of changes in speed of said engine, said fluid pressure changes effecting movement of said movable element with respect to its said changed position to increase said open condition of said valve with decreasing speed of said engine and to decrease said open condition of said valve with increasing speed of said engine, thereby mainting substantially uniform speed of said engine corresponding to said selected speed.

11. A carburettor according to claim 10, wherein said movable element is a diaphragm whose position within said second chamber is determined by the tension in both said spring means and the differential pressure of fluids in both said compartments.

12. A carburettor according to claim 10, including a plurality of said cam faces each adjacent a respective cam dwell on a face of said throttle control member, each cam face having ramp-like shape, said carriage having a plurality of radially extending arms engageable in respective ones of said cam dwells, when said valve is fully opened and contacting said ramp-like cam faces when said valve is partly closed.

13. A carburettor according to claim 10, wherein the air from said air inlet means passes to said valve seat via a plurality of orifices, said throttle member carrying a plurality of depending leg projections which at least partly close respective orifices in one rotated position of said throttle control member.

* * * * *